US006899518B2

(12) United States Patent
Lucas et al.

(10) Patent No.: US 6,899,518 B2
(45) Date of Patent: May 31, 2005

(54) TURBINE SHROUD SEGMENT APPARATUS FOR REUSING COOLING AIR

(75) Inventors: Terrence Lucas, Candiac (CA); Dominic Bédard, Longueuil (CA); Amir Daniel, Kirkland (CA); Remy Synnott, Varennes (CA)

(73) Assignee: Pratt & Whitney Canada Corp., Quebec (CA)

( * ) Notice: Subject to any disclaimer, the term of this patent is extended or adjusted under 35 U.S.C. 154(b) by 128 days.

(21) Appl. No.: 10/325,941

(22) Filed: Dec. 23, 2002

(65) Prior Publication Data

US 2004/0120803 A1 Jun. 24, 2004

(51) Int. Cl.[7] ..... F04D 31/00
(52) U.S. Cl. ..... 415/116; 415/173.1; 415/178
(58) Field of Search ..... 415/173.1, 173.4, 415/174.4, 115, 116, 178, 180

(56) References Cited

U.S. PATENT DOCUMENTS

| | | | |
|---|---|---|---|
| 3,742,705 | A | 7/1973 | Sifford |
| 3,825,364 | A | 7/1974 | Halila et al. |
| 3,844,343 | A | 10/1974 | Burggraf |
| 4,017,207 | A | 4/1977 | Bobo et al. |
| 4,177,004 | A | 12/1979 | Riedmiller et al. |
| 4,526,226 | A | 7/1985 | Hsia et al. |
| 4,551,064 | A | 11/1985 | Pask |
| 4,573,865 | A | 3/1986 | Hsia et al. |
| 5,048,288 | A | 9/1991 | Bessette et al. |
| 5,480,281 | A | 1/1996 | Correia |
| 6,139,257 | A | 10/2000 | Proctor et al. |
| 6,146,091 | A | 11/2000 | Watanabe et al. |
| 6,155,778 | A | 12/2000 | Lee et al. |
| 6,196,792 | B1 | 3/2001 | Lee et al. |
| 6,302,642 | B1 | 10/2001 | Nagler et al. |
| 6,354,795 | B1 | 3/2002 | White et al. |
| 6,390,769 | B1 | 5/2002 | Burdgick et al. |
| 6,612,806 | B1 | 9/2003 | Bolms et al. |

FOREIGN PATENT DOCUMENTS

| | | |
|---|---|---|
| EP | 0 709 550 | 5/1996 |
| EP | 0 940 562 | 9/1999 |
| JP | 02 091402 | 3/1990 |
| JP | 11 257003 | 9/1999 |
| WO | WO 00 60219 | 10/2000 |

*Primary Examiner*—F. Daniel Lopez
*Assistant Examiner*—Dwayne White
(74) *Attorney, Agent, or Firm*—Ogilvy Renault

(57) ABSTRACT

A cooled turbine shroud segment for a gas turbine engine, having an axially extending shroud ring segment with an inner surface, an outer surface, an upstream flange and a downstream flange. The flanges mount the shroud ring within an engine casing. A perforated cooling air impingement plate is disposed on the outer surface of the shroud ring between the upstream flange and the downstream flange, with an impingement plenum defined between the impingement plate and the outer surface. Axially extending cooling bores in the ring segment extend between the impingement plenum and an outlet. A trough adjacent the outlet directs cooling air from the outlet towards a downstream stator vane to cool the stator vane.

20 Claims, 6 Drawing Sheets

TURBINE SHROUD SEGMENT APPARATUS FOR REUSING COOLING AIR

TECHNICAL FIELD

The invention relates to a gas turbine cooled shroud assembly segment.

BACKGROUND OF THE ART

A portion of the core air flow from the compressor section of a gas turbine engine is typically used for air cooling of various components that are exposed to hot combustion gases, such as the turbine blades and turbine shrouds.

Since a portion of the energy created by combustion is utilized to drive the compressor and create compressed air, use of compressed cooling air represents a necessary penalty and energy loss for the engine. Obviously, any minimization of the compressed air portion used for cooling would represent an increase in the efficiency of the engine. While cooled shroud segments are well known in the art, the potential efficiency savings that can be achieved by even small reductions in the amount of secondary cooling air required means that improvement to known devices are consistently sought and highly valued.

It is therefore an object of the present invention to provide a cooled shroud assembly in which spent cooling air from the turbine shroud is reused downstream.

Further objects of the invention will be apparent from review of the disclosure, drawings and description of the invention below.

DISCLOSURE OF THE INVENTION

The invention provides a cooled turbine shroud segment for a gas turbine engine, having an axially extending shroud ring segment with an inner surface, an outer surface, an upstream flange and a downstream flange. The flanges mount the shroud ring within an engine casing. A perforated cooling air impingement plate is disposed on the outer surface of the shroud ring between the upstream flange and the downstream flange, with an impingement plenum defined between the impingement plate and the outer surface. Axially extending cooling bores in the ring segment extend between the impingement plenum and an outlet. A trough adjacent the outlet directs cooling air from the outlet towards a downstream stator vane to cool the stator vane.

DESCRIPTION OF THE DRAWINGS

In order that the invention may be readily understood, an embodiment of the invention is illustrated by way of example in the accompanying drawings.

Further details of the invention and its advantages will be apparent from the detailed description included below.

DETAILED DESCRIPTION OF PREFERRED EMBODIMENTS

Figure 1:
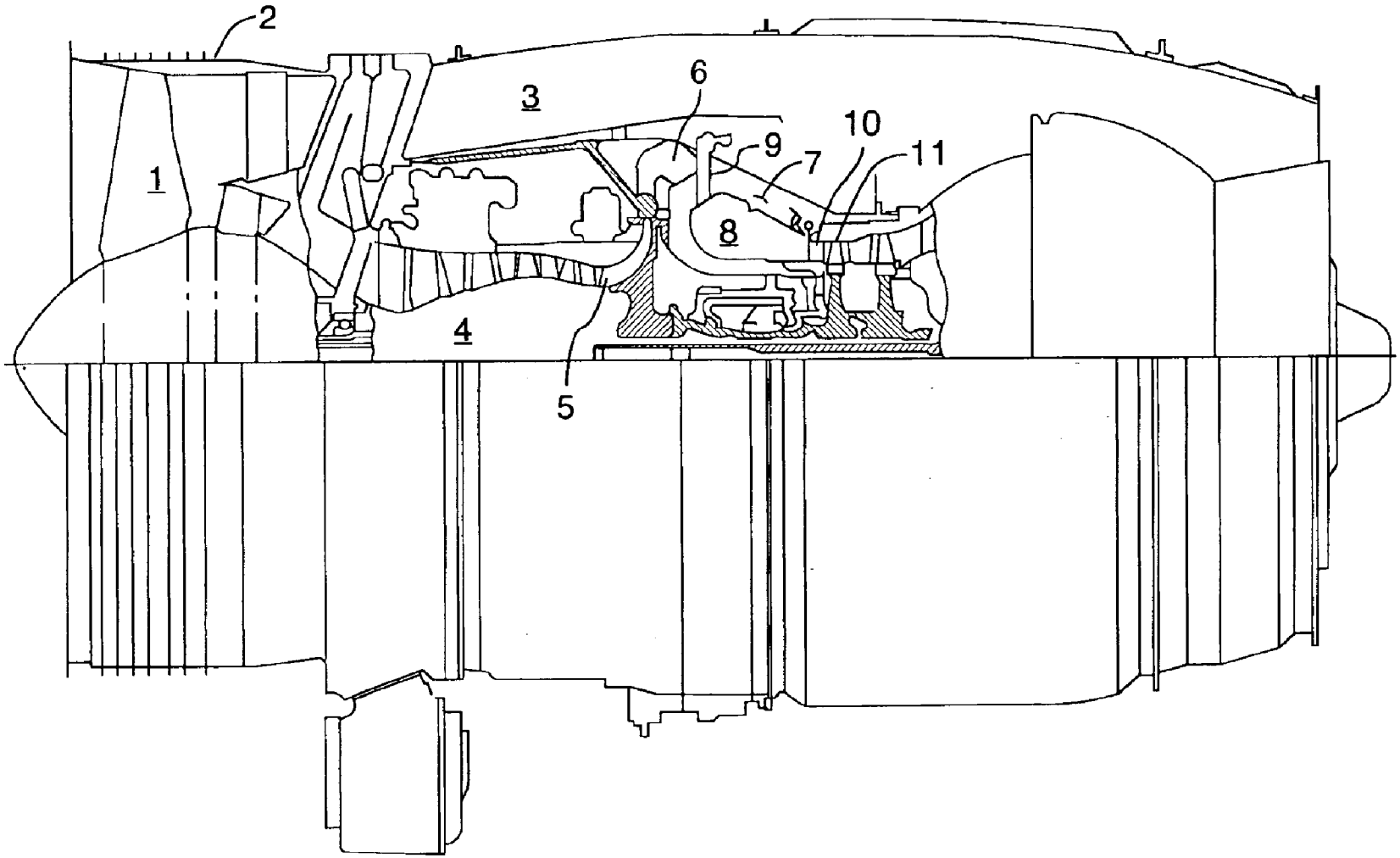
FIG. 1 is an axial cross-sectional view through a turbofan gas turbine engine showing the general arrangement of components.

FIG. 1 shows an axial cross-section through a turbofan gas turbine engine. It will be understood however that the invention is equally applicable to any type of gas turbine engine with a turbine section such as a turboshaft, a turboprop, or auxiliary power unit. Air intake into the engine passes over fan blades 1 in a fan case 2 and is then split into an outer annular flow through the bypass duct 3 and an inner flow through the low-pressure compressor 4 and high-pressure compressor 5. Compressed air exits the compressor 5 through a diffuser 6 and is contained within a plenum 7 that surrounds the combustor 8. Fuel is supplied to the combustor 8 through fuel manifold 9 which is mixed with air from the plenum 7 when sprayed through nozzles into the combustor 8 as a fuel-air mixture that is ignited. A portion of the compressed air within the plenum 7 is admitted into the combustor 8 through orifices in the side walls to create a cooling air curtain along the combustor walls or is used for cooling to eventually mix with the hot gases from the combustor and pass over the nozzle guide vanes 10 and turbines 11 before exiting the tail of the engine as exhaust.

Figure 2:
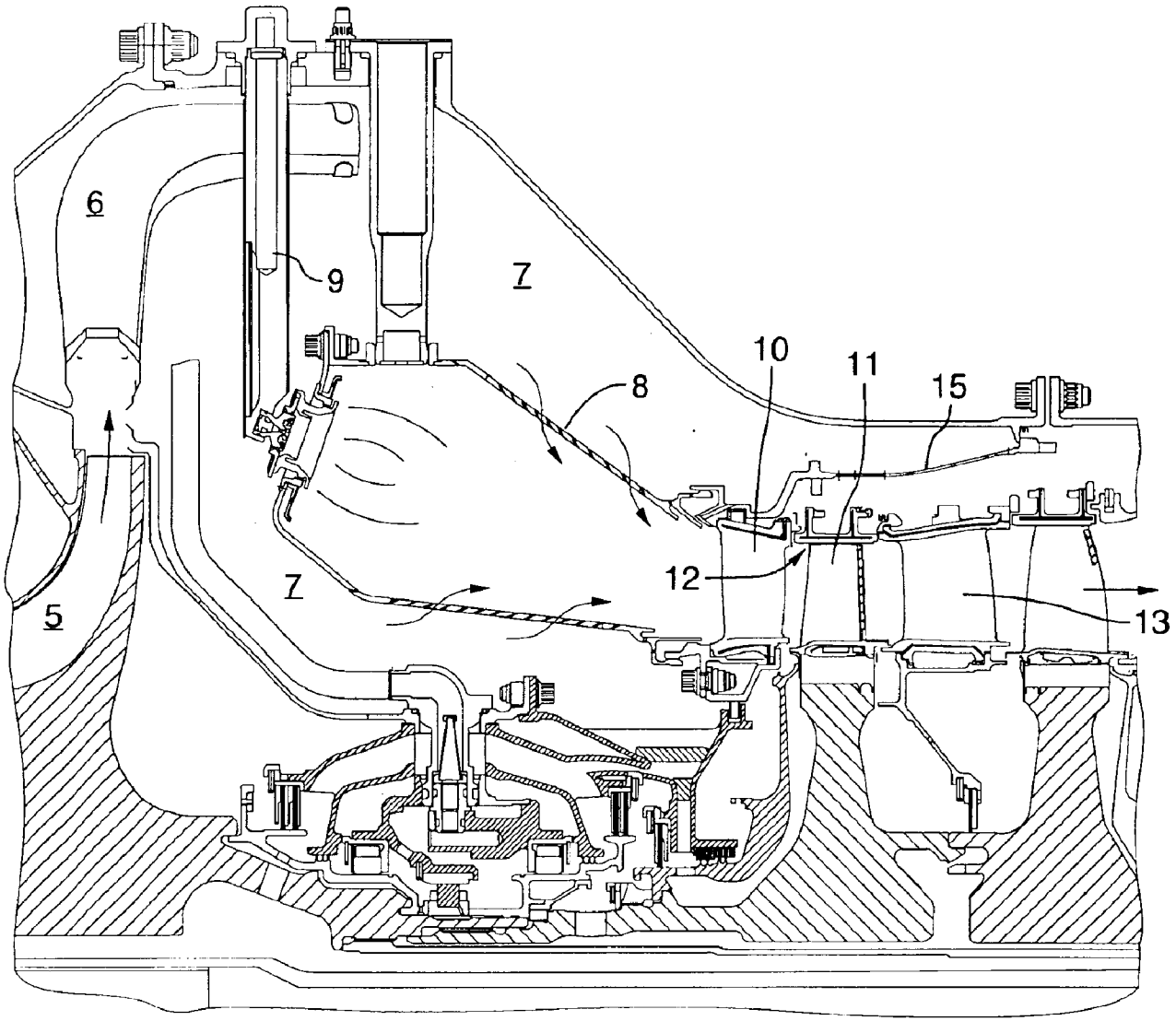
FIG. 2 is a detailed axial cross-sectional view through the centrifugal compressor, diffuser and plenum surrounding a combustor with stator vane rings and associated high pressure turbines with surrounding air cooled shrouds.
Figure 3:
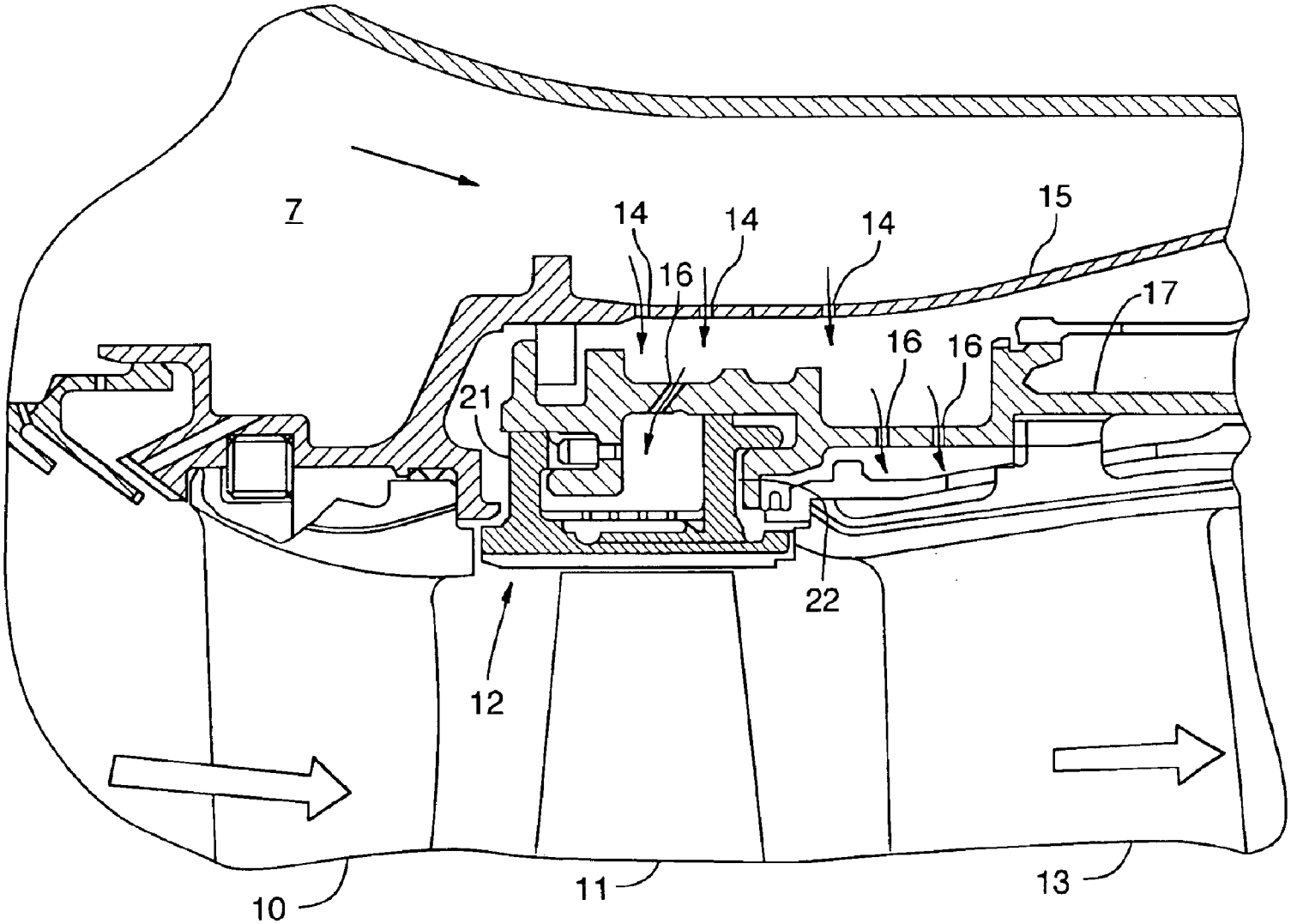
FIG. 3 is a detailed axial sectional view through the turbine shroud showing airflow and associated components.
Figure 4:
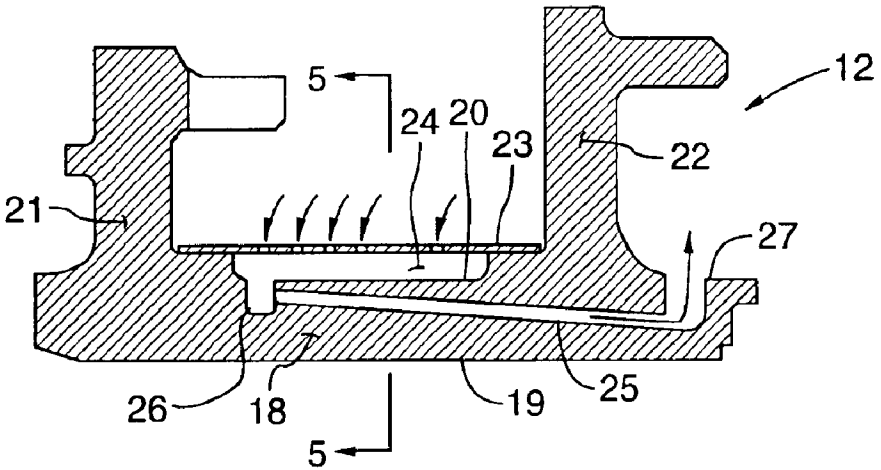
FIG. 4 is an axial sectional view through an air cooled shroud segment showing axially extending bores through the shroud ring portion.

As best shown in FIGS. 2 and 3, the air cooled shroud 12 functions to duct the hot gas exiting from the combustor 8 in conjunction with the blade platforms of the turbine 11, and upstream nozzle guide vane 10 and a downstream stator vane ring 13. The shroud 12 is cooled by compressed air conducted from the plenum 7 which surrounds a combustor 8 through air flow distribution holes 14 in the engine casing 15. Cooling air then proceeds through distribution holes 16 in the support casing 17 directed toward the shroud 12 and toward the stator vane ring 13, as is well known in the art. According to the present invention, however, a portion of the cooling flow impinging on shroud 12 is ducted there through and directed towards other components to achieve additional cooling benefits.

Figure 5:
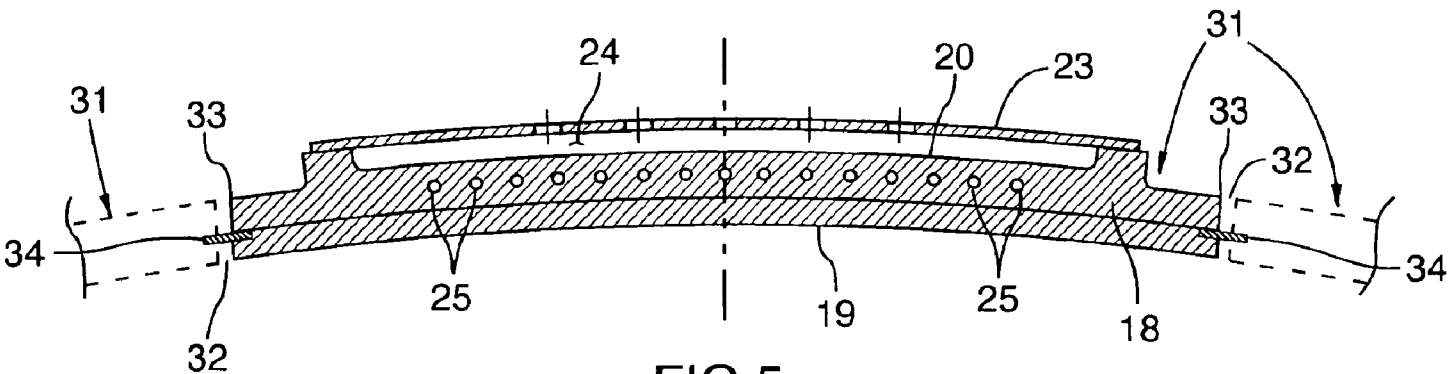
FIG. 5 is a radial sectional view through a shroud section as indicated by lines 5—5 in FIG. 4.
Figure 6:
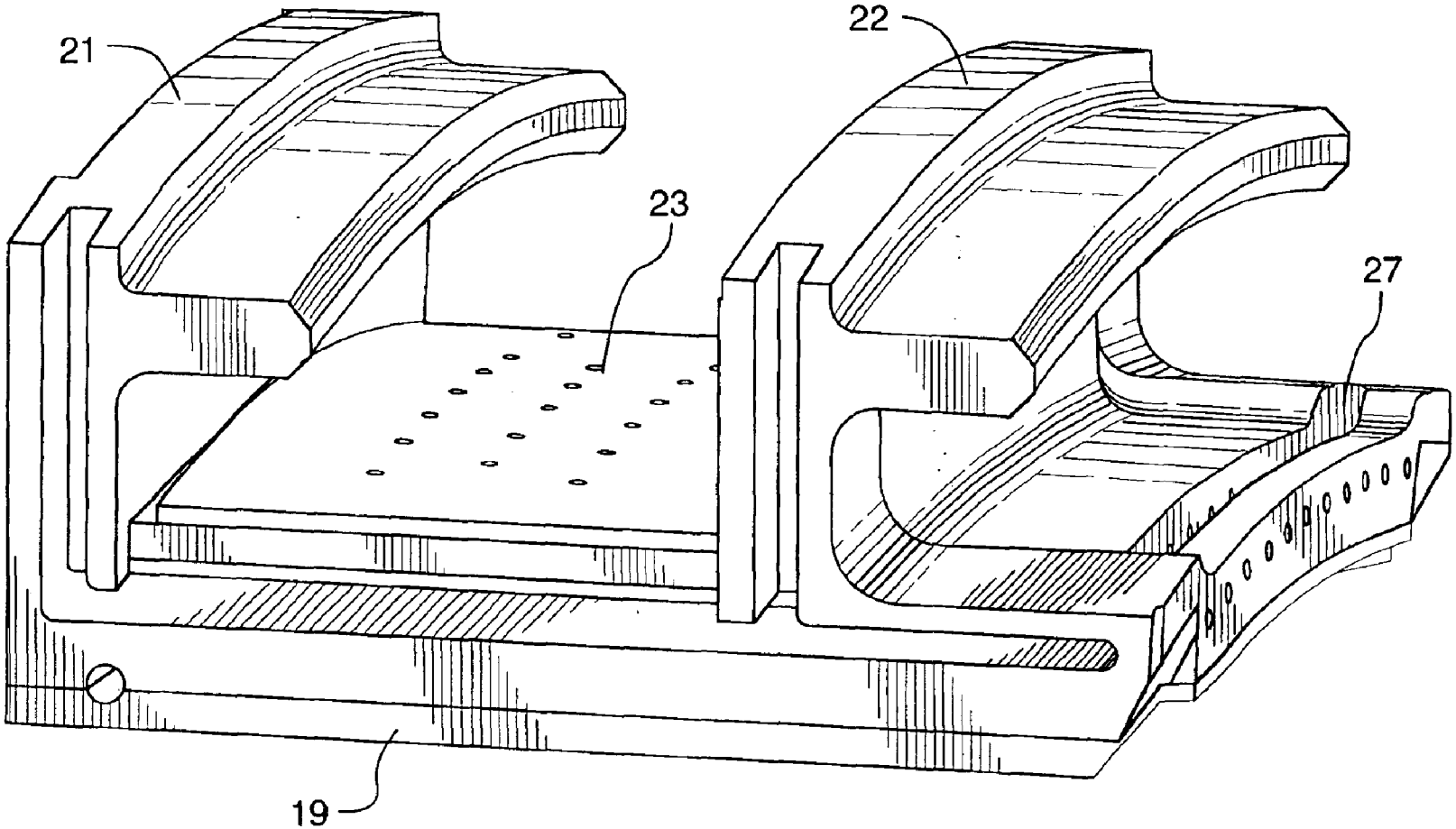
FIG. 6 is an isometric view of a shroud segment.
Figure 7:
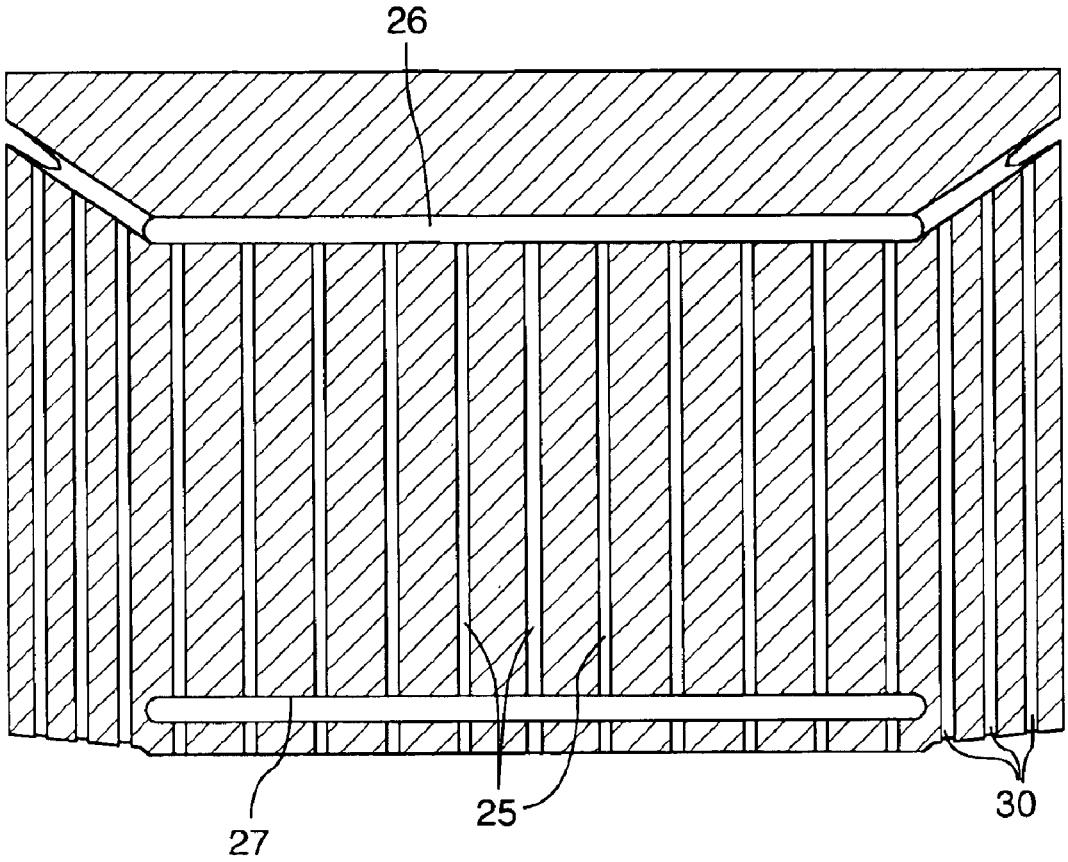
FIG. 7 is a sectional view through the shroud segment in the plane of the axially extending bores.
Figure 8:
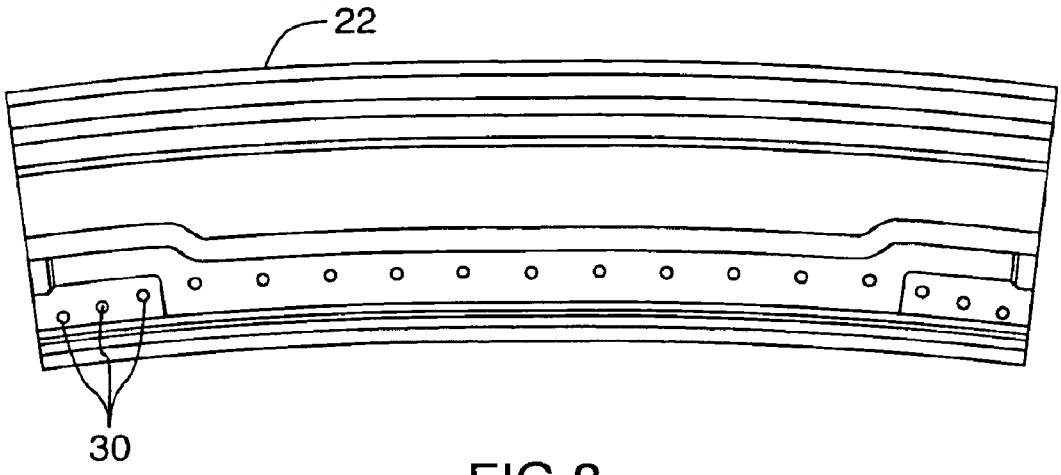
FIG. 8 is a radial end view of the shroud segment.

As seen in FIGS. 4–8, the air cooled shroud segment 12 typically has an axially extending shroud ring 18 with an inner surface 19 and outer surface 20, an upstream attachment flange 21 and a downstream attachment flange 22. The flanges 21 and 22 include axially extending rails to interlock with the support casing 17. The shroud segment 12 also optionally includes a perforated cooling air impingement plate 23 which is brazed or otherwise fixed to the outer surface 20 of the shroud ring 18. An impingement plenum 24 is thus defined between the perforated impingement plate 23 and the outer surface 20 of the shroud ring 18. According to the present invention and as best seen in FIG. 5, the ring 18 also includes a plurality of axially extending cooling bores 25 defined therein which communicate between the impingement plenum 24 and an air outlet which is downstream in the shroud ring 18 and adapted to deliver air to the stator vane ring 13 as described below.

The radially outer surface 20 of the shroud ring 18 preferably includes an upstream circumferential trough 26 which is open to the impingement plenum 24 and is in communication with at least one of the longitudinal bores 25. The inclusion of troughs 26 aids in evacuating the spent impingement cooling air and conducting air through the bores 25 for further cooling of the thermal mass of the shroud ring 18. According to the present invention the outer surface 20 of the ring 18 also preferably includes a downstream circumferential trough 27, with at least one axially extending cooling bore 25 communicating between the plenum 24 and the downstream trough 27.

Therefore, in use cooling air passes through the impingement plate 23 and impingement cooling jets are directed at the outer surface 20 of the shroud ring 18 as shown in FIG. 4–8. The impingement cooling air is then collected preferably in the trough 26 and then directed through the cooling bores 25 eventually exiting the segment 12. The trough 27 is provided to redirect the secondary air flow towards another component, in this case a downstream stator vane 13 to permit further cooling to be effected by the secondary air flow. In addition to cooling air which is supplied via distribution hole 16 in the support casing 17 to the stator vane ring 13, the downstream circumferential trough 27 provides reused air from the shroud 12 by conducting air from the trough 27 to another structure, such as the downstream vane 13. Optionally, the vane 13 can have bores (not shown) therein to further direct the cooling flow therethrough. In the prior art, spent cooling air from the shroud 12 is usually exhausted directly into the hot gas path from the trailing edge of the shroud segment 12. The invention provides for reuse of the spent cooling air from the shroud 12 by conducting cooling air through the downstream circumferential trough 27 to be reused by the downstream stator vane ring 13.

As seen in FIG. 5, the annular shroud 12 is preferably made of a plurality of circumferentially spaced apart shroud segments 31 with axially extending gaps 32 between joint edges 33 of adjacent segments 31. Feather seals 34 extend across the gaps 32.

Referring to FIG. 4–8, the trough 27 may optionally include exit holes 30 to permit a portion of secondary cooling air to be exhausted to the hot gas path while another portion is redirected as described above. This permits the cooling flow to be tuned to structural and cooling requirements. A face seal is formed by abutment of the downstream face of the shroud segment 12 with the upstream face of the vane segment.

Although the above description relates to a specific preferred embodiment as presently contemplated by the inventor, it will be understood that the invention in its broad aspect includes mechanical and functional equivalents of the elements described herein. For example, the redirecting trough 27 may be replaced by any device which suitably serves to redirect the secondary air flow. The shroud segment 12 may have any number of configurations other than the typical one described above. Cooling bores 25 need not be exactly as described and other means of ducting the secondary flow to redirecting trough 27 may be employed with satisfactory result. The impingement plate 23 may not be present, but rather P3 (or other) cooling air may be directly supplied to the outer face of the shroud.

We claim:

1. A cooled turbine shroud segment for a gas turbine engine, the shroud segment comprising:

an axially extending shroud ring segment having an inner surface, an outer surface, an upstream flange and a downstream flange, the flanges adapted to mount the shroud ring within an engine casing;

a plurality of axially extending cooling bores defined in the ring segment and communicating between at least one inlet and an outlet; and a trough adjacent the outlet for directing cooling air exiting from the outlet towards a downstream stator vane to cool said stator vane.

2. A cooled turbine shroud segment according to claim 1 wherein a portion of the cooling air from the outlet exits directly to the gas path.

3. A cooled turbine shroud segment according to claim 1 further comprising a perforated cooling air impingement plate disposed on the outer surface of the shroud ring between the upstream flange and the downstream flange, and an impingement plenum being defined between the impingement plate and the outer surface, wherein the impingement plenum communicates with the at least one inlet.

4. A cooled turbine shroud segment for a gas turbine engine, the shroud segment comprising:

a body member, the body member being a ring segment having inner and outer surfaces and attachment members adapted to mount the body member within an engine casing;

at least one duct defined in the body member, the duct adapted to conduct cooling air to impinge on the body member outer surface and thereafter to an outlet; and a redirecting portion adapted to direct at least a portion of the cooling air exiting from said outlet to an air cooled component in the gas turbine engine.

5. A cooled turbine shroud segment according to claim 4 wherein the air cooled component is downstream from the shroud segment.

6. A cooled turbine shroud segment according to claim 4 wherein the air cooled component is a stator vane.

7. A cooled turbine shroud segment according to claim 4 wherein the outlet is downstream.

8. A cooled turbine shroud segment according to claim 4 including a plurality of ducts through the body.

9. A cooled turbine shroud segment according to claim 4 wherein the duct further includes a plenum adjacent the outside surface defined by an impingement baffle spaced from the surface.

10. A cooled turbine shroud segment according to claim 4 wherein the redirecting portion is a trough.

11. A method of cooling a turbine shroud segment comprising the steps of:

impinging a secondary cooling flow against an exterior surface of the shroud segment;

conveying a first portion of the cooling air flow after impinging on the exterior surface through the shroud segment to exit directly to the gas path; and conveying a second portion of the cooling air flow after impinging on the exterior surface through the shroud segment to an air cooled component in the gas turbine engine.

12. A method of cooling a turbine shroud segment according to claim 11 wherein the air cooled component is downstream from the shroud segment.

13. A method of cooling a turbine shroud segment according to claim 11 wherein the air cooled component is a stator vane.

14. A method of cooling a turbine shroud segment according to claim 13 wherein the cooling air is directed to cool the stator vane.

15. A method of cooling a turbine shroud segment according to claim 11 wherein the first and second portions are conveyed downstream.

16. A method of cooling a turbine shroud segment according to claim 11 including a plurality of ducts through the segment.

17. A method of cooling a turbine shroud segment according to claim 11 wherein the segment further includes a plenum adjacent an outside surface defined by an impingement baffle spaced from the surface.

18. A method of cooling a turbine shroud segment according to claim 11 using a trough to redirect the second portion of the cooling flow.

19. An air cooled annular shroud comprising:

a plurality of circumferentially spaced apart axially extending shroud ring segments with axially extending gaps between joint edges of adjacent segments, each segment having an inner surface, an outer surface, an upstream flange and a downstream flange, the flanges adapted to mount the shroud ring within an engine casing;

a perforated cooling air impingement plate disposed on the outer surface of the shroud ring between the upstream flange and the downstream flange, an impingement plenum being defined between the impingement plate and the outer surface;

a plurality of axially extending cooling bores defined in the ring segment and communicating between the impingement plenum and an outlet; and a trough adjacent the outlet for directing cooling air exiting from the outlet towards a downstream stator vane to cool said stator vane.

20. An air cooled shroud according to claim 19 comprising feather seals spanning said gaps, with one said axial trough disposed adjacent each joint edge.

* * * * *